United States Patent [19]

Braathen

[11] Patent Number: 4,488,138

[45] Date of Patent: Dec. 11, 1984

[54] THREE-STAGE TEMPERATURE SWITCH, PREFERABLY FOR A HOT WATER HEATER

[76] Inventor: Thor F. Braathen, N-3358 N. Eggedal, Norway

[21] Appl. No.: 436,817

[22] Filed: Oct. 26, 1982

[51] Int. Cl.[3] ..... H01H 37/52

[52] U.S. Cl. ..... 337/338; 337/334; 337/348

[58] Field of Search ..... 337/1, 12, 13, 299, 337/334, 335, 336, 337, 338, 339, 340, 348, 370, 371

[56] References Cited

U.S. PATENT DOCUMENTS

| | | | |
|---|---|---|---|
| 3,242,293 | 3/1966 | Manecke | 337/338 |
| 3,435,189 | 3/1969 | Manecke | 337/348 |
| 3,470,516 | 9/1969 | Basse | 337/335 |
| 3,493,911 | 2/1970 | Broetto | 337/299 |
| 3,885,222 | 5/1975 | Manecke | 337/338 |

*Primary Examiner*—Harold Broome
*Attorney, Agent, or Firm*—Young & Thompson

[57] ABSTRACT

A three-stage temperature switch, preferably for hot water heaters, having regulator contacts in the 1- and 2-branches of the switch, wherein the operating thermostat and the safety thermostat are connected to the casing of the three-stage switch for, respectively, maintaining an operating temperature by connecting and disconnecting an electric circuit via an operating contact in the L-branch of the switch, and monitoring a higher, critical temperature for disconnecting the electric circuit via switching contacts in the 1-, 2- and L-branches of the switch if the critical temperature (e.g., 95° C.) is exceeded. The switching contacts are constituted by the regulator contacts and by a switching contact on the L-branch, which three contacts may be simultaneously actuated by an adjacent body which has mechanical contact with and is moved by the safety thermostat. If the critical temperature is exceeded, the safety thermostat will snap from its operative position into its inverted position, thereby opening the contacts and disconnecting the heating element of the hot water heater. The three-stage switch is provided with a reset button for restoring the safety thermostat to its noninverted, operative position, thereby closing the contacts.

4 Claims, 4 Drawing Figures

THREE-STAGE TEMPERATURE SWITCH, PREFERABLY FOR A HOT WATER HEATER

The present invention relates to a three-stage temperature switch, preferably for a hot water heat.

Three-stage switches of the above type are known and used wherein the safety thermostat actuates switching contacts for disconnecting the electric circuit, for example the heating element in a hot water heater, when the water temperature reaches an upper critical value, e.g., 95° C. These switching contacts, together with regulator contacts and the operating contact, the latter being actuated by the operating thermostat which maintains a desired operating temperature in the hot water heater, together constitute a larger number of components and associated connections which it would be desirable to reduce, both to obtain a three-stage switch which is less expensive to produce and to reduce the space requirements of the unit.

Figure 1:
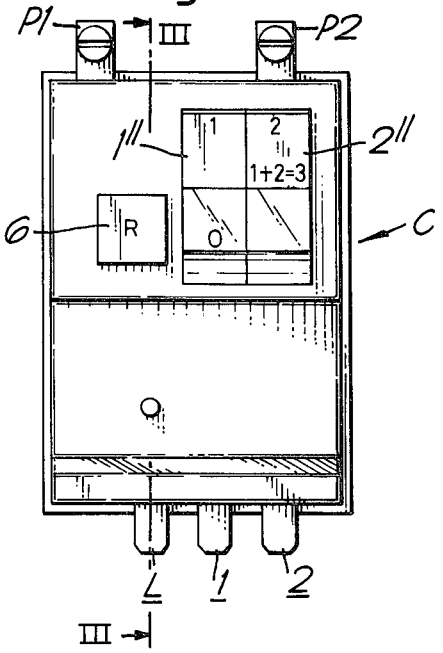
Figure 2:
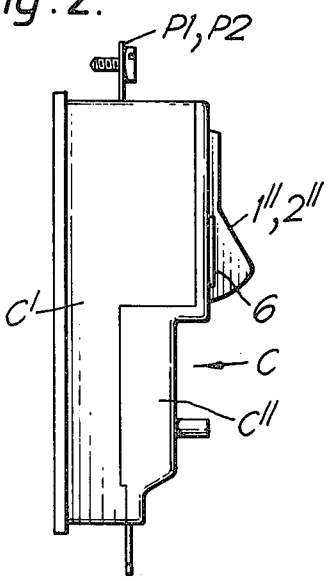
Figure 3:
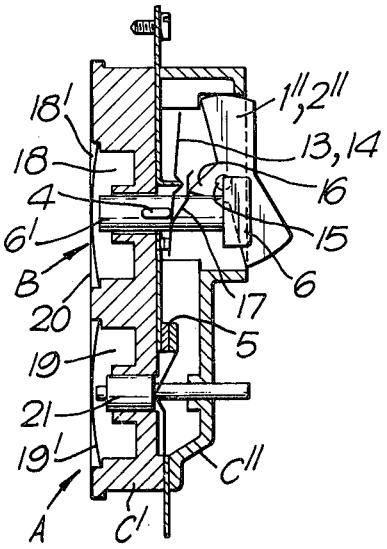
Figure 4:
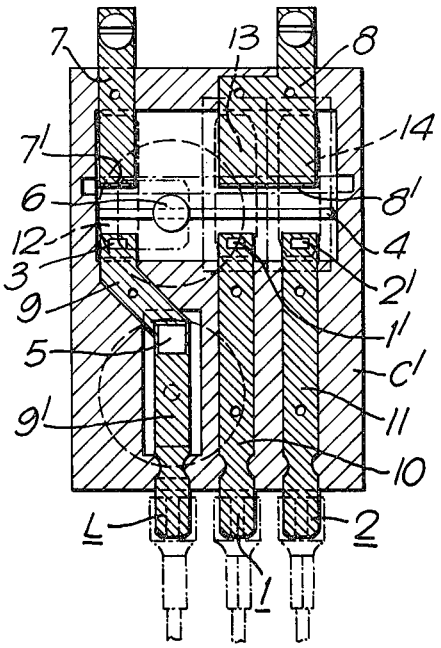

An embodiment of the invention is schematically illustrated in the accompanying drawing, wherein:

FIGS. 1 and 2 show the casing of the three-stage switch with control buttons and terminals, seen in plan view and side view, respectively, FIG. 3 shows a cross section through the three-stage switch along the line III—III in FIG. 1, and FIG. 4 shows the three-stage switch in plan view, with the upper portion of the casing and its components removed.

The three-stage switch illustrated in the drawing consists of a casing C with terminals P1 and P2 for current supply and three terminals L, 1 and 2, i.e., the L-, 1- and 2-branches of the three-stage switch. Control buttons 1'', 2'' and a reset button 6 (see FIG. 1) are located on the top side of the casing C. The casing C consists of a base plate C' and a cover C''. Secured to the base plate C' are electrically conductive rails 7,8,9,10,11, which constitute parts of the L-, 1- and 2-branches of the three-stage switch.

The rails 7 and 8, which comprise the terminals P1, P2 are arranged at one end section of the base plate C', while the rails 10 and 11, which comprise the terminals 1 and 2 for the 1- and 2-branches, extend from a point spaced apart from the rail 8 and project beyond the opposite end of the base plate C'. The rail 9 extends from a point spaced apart from the rail 7 to a point within the base plate C', where it is provided with a contact which together with another contact on a spring rail 9' fastened to the base place C' forms a pair of contacts 5 which bear resiliently against each other. The opposite end of the spring rail 9' constitutes the terminal for the L-branch. The end sections of the rails 9,10,11 proximate the rails 7 and 8 are provided with contacts aligned transversely of the base plate C' and are intended to cooperate with contacts on spring rails 12, 13 and 14, thus forming pairs of contacts 3, 1' and 2'. The rail 12 is in electrical contact with the rail 7 and together with the rails 9 and 9' constitutes the above-mentioned L-branch. The contacts in the pair of contacts 3 bear resiliently against each other.

The spring rails 13 and 14 constitute snap-action contact carriers in the three-stage switch, being rocker-mounted on a cam 8' on the end of the rail 8 opposite the terminal P2. The rails 13, 14 are caused to rock back and forth between open and closed positions for the pairs of contacts 1' and 2' by means of the above-mentioned control buttons 1'' and 2'' which are mounted on the cover C'' of the casing C by means of an axle 15. On the underside of the control buttons, there are projections 16 which act upon a resilient lip 17 on each of the rails 13 and 14, said projections being placed such that when the point of contact of the projection 16 moves on the lip 17, the rails 13, 14 are rocked back and forth about their pivot point on the cam 8'. In the illustrated embodiment of the threestage switch, the rail 7 is also provided with a cam 7' which is in alignment with the cam 8' and against which the rail 12 is pressed and held in position when the cover C'' is placed on the unit.

In the bottomm of the base place C', there are outwardly open recesses 18, 19 in which outwardly convex bimetal discs 18', 19' are positioned, said discs constituting respectively a safety thermostat B and an operating thermostat A. Disposed on the bottom of the base place C' is a contact place which covers the recesses 18, 19 and is intended to lie in contact against a surface which gives off heat, for example the jacket of the hot water heater; thus, the thermostats A and B are subjected to influence by heat via the contact plate 20. A rod 6', which constitutes a part of the reset button 6, is arranged axially movable in a guide in the bottom of the recess 18 and lies in contact with the bimetal disc 18', which operates with a snap-action, i.e., from an operative position it suddenly inverts with a snap into the opposite position at the critical temperature, e.g., 95° C., thereby simultaneously moving the rod 6'. A cross bar 4 is provided on the rod 6', and when the rod 6' is moved axially as stated above, the cross bar will bear against the spring rails 13, 14 and thereby force one or both pairs of contacts 1', 2' apart, in the event they are closed by means of one or both control buttons 1'', 2''. During said movement of the rod 6', the cross bar 4 will also press against the rail 12 and thereby open the pair of contacts 3. In this manner, all of the contacts 3, 1', 2' in the L-, 1- and 2-branches of the switch are opened if the critical temperature in the hot water heater is exceeded, thus disconnecting its heating element. The operating thermostat A is formed in the same way as the safety thermostat B, the bimetal disc 19' actuating a rod 21 which is axially movable in a bore in the bottom of the recess 19. The rod 21 bears against the rail 9' which carries one contact of the pair of contacts 5, and the axial movement of the rod back and forth closes and opens the pair of contacts 5. The bimetal disc 19', in the operating thermostat A will invert and reverse as the temperature in the jacket of the hot water heater exceeds or goes below a desired level, e.g., 85° C. thereby opening and closing the pair of contacts 5, which may appropriately be termed the operating contact 5.

In the three-stage switch described above, all of the members for monitoring and maintaining a desired temperature in the hot water heater and for disconnection if a critical temperature is exceeded are built into the three-stage switch in such manner that the switching contacts 1', 2' also constitute regulator contacts which are actuated by the control buttons 1'', 2''. Therefore, both the number of contacts and the connections between contacts are reduced in relation to previously known three-stage switches with built-in thermostats.

During operation of the hot water heater, with the 1-branch and/or 2-branch connected, the operating thermostat A will monitor the temperature in the hot water heater and open and close the operating contact 5 for maintaining a desired operating temperature of, e.g., 85° C. In the event that the operating contact 5 for some reason becomes fused so that it cannot be opened by the operating thermostat A, the temperature in the hot water heater will rise to the critical temperature, for example 95° C., at which point the safety thermostat B will snap into its inverted position and, via the rod 6' and cross bar 4, open the switching contacts 3, 1', 2', thereby disconnecting the circuit to the heating element.

When hot water is being consumed, the temperature in the hot water heater will sink below the critical temperature and the operating temperature, but the safety thermostat B will not invert, being as mentioned earlier, of the snap-action type.

When it is discovered that the heating element of the hot water heater has been disconnected by the safety thermostat, the electrical circuit can be reconnected to the heating element by depressing the reset button 6, whereby the safety thermostat B is returned to its non-inverted, operative position by means of the rod 6' that supports the cross bar 4, which simultaneously permits the contact-carrying rails 12,13,14 to spring back into closed contact with the contacts on the rails 9, 10, 11, thus closing the combined switching-regulator pairs of contacts 1', 2'. In this manner the heating element on the heater can be connected for heating water a number of times by means of the reset button, until the operating contact 5 has been repaired or the three-stage switch has been replaced.

Having described my invention, I claim:

1. A three-stage temperature switch, comprising a casing, an operating thermostat and a safety thermostat connected to the casing, the switch having L-, 1- and 2-branches, an operating contact in the L-branch operable by said operating thermostat, switching contacts in said L-, 1- and 2-branches actuable simultaneously by said safety thermostat at a higher temperature than the temperature at which the operating thermostat actuates said operating contact, and means selectively individually to actuate said switching contacts in said 1- and 2-branches independently of said safety thermostat.

2. A switch as claimed in claim 1, and a body in contact with all three of said switching contacts, said safety thermostat moving said body to actuate said switching contacts.

3. A switch as claimed in claim 2, said body comprising a cross bar.

4. A switch as claimed in claim 2, and a reset button for resetting said safety thermostat, said reset button moving said body to reset said switching contacts.

* * * * *